United States Patent [19]

Howell

[11] Patent Number: 4,542,870

[45] Date of Patent: Sep. 24, 1985

[54] SSICM GUIDANCE AND CONTROL CONCEPT

[75] Inventor: W. Max Howell, Orlando, Fla.

[73] Assignee: The United States of America as represented by the Secretary of the Army, Washington, D.C.

[21] Appl. No.: 521,490

[22] Filed: Aug. 8, 1983

[51] Int. Cl.[4] ..... F41G 7/22

[52] U.S. Cl. ..... 244/3.15

[58] Field of Search ..... 244/3.15, 3.16, 3.19, 244/3.21, 3.22, 3.23

[56] References Cited

U.S. PATENT DOCUMENTS 3,414,215 12/1968 Martin et al. ..... 244/3.15

3,740,002 6/1973 Schaefer ..... 244/3.19

3,897,918 8/1975 Gulick, Jr. et al. ..... 244/3.19

4,204,655 5/1980 Gulick et al. ..... 244/3.19

*Primary Examiner*—Charles T. Jordan

*Attorney, Agent, or Firm*—John H. Raubitschek; Werten F. W. Bellamy; Robert C. Sims

[57] ABSTRACT

The guidance scheme utilizes wide beam width semi-active RF sensors, a precision roll altitude reference, and a controlled grade pitch, yaw and roll rate gyros to deliver high quality homing guidance information to a spin stabilized controlled missile. A filtering system is utilized to eliminate errors caused by body roll signals generated due to the spin of the missiles. The nutational motion is used to calibrate the sensors. Impulsive maneuvers are utilized to intercept incoming ballistic targets.

2 Claims, 8 Drawing Figures

SSICM GUIDANCE AND CONTROL CONCEPT

DEDICATORY CLAUSE

The invention described herein was made in the course of or under a contract or subcontract thereunder with the Government and may be manufactured, used, and licensed by or for the Government for governmental purposes without the payment to me of any royalties thereon.

BACKGROUND OF THE INVENTION

Spin Stabilized Impulsively Controlled Missile (SSICM) was conceived as a low cost non-nuclear ground to air interceptor of very high speed targets such as offensive missiles. It was also conceived to achieve very small miss distances. The key feature that permits a small miss is the extremely fast maneuver response time. The fast response time is achieved by employing liquid pulse motors which produce a quantum change in lateral velocity in 0.004 to 0.008 seconds. The amplitude of the quantum velocity change is maximized by keeping the vehicle weight down. Weight has been minimized by the following techniques.

a. Spin stabilization eliminates the need for an autopilot, aerodynamic control surfaces, control surface actuators, control accelerometers, and associated power supplies.

b. The body mounted sensor eliminates the need for stabilization gimbals, stabilization gyros, resolvers, and associated structure and power supplies.

The SSICM guidance and control scheme utilizes the outputs of a wide beamwidth semiactive RF sensor, a precision roll attitude reference, and control grade pitch, yaw and roll rate gyros to derive high quality homing guidance information. This system, when combined with a spinning and fast responding interceptor, provides the capability to intercept incoming ballistic reentry vehicles with very small miss distance.

The SSICM missile can be used to defend Minuteman, MX or tactical missile sites. Conventional homing missiles require gimbaled seekers, attitude control systems, and generally use time consuming aerodynamic maneuvers to control miss distance. SSICM uses impulsive maneuvers derived from liquid pulse motors, and is capable of producing very small miss distance because of its fast response.

DESCRIPTION OF THE BEST MODE AND PREFERRED EMBODIMENT

Figure 1:
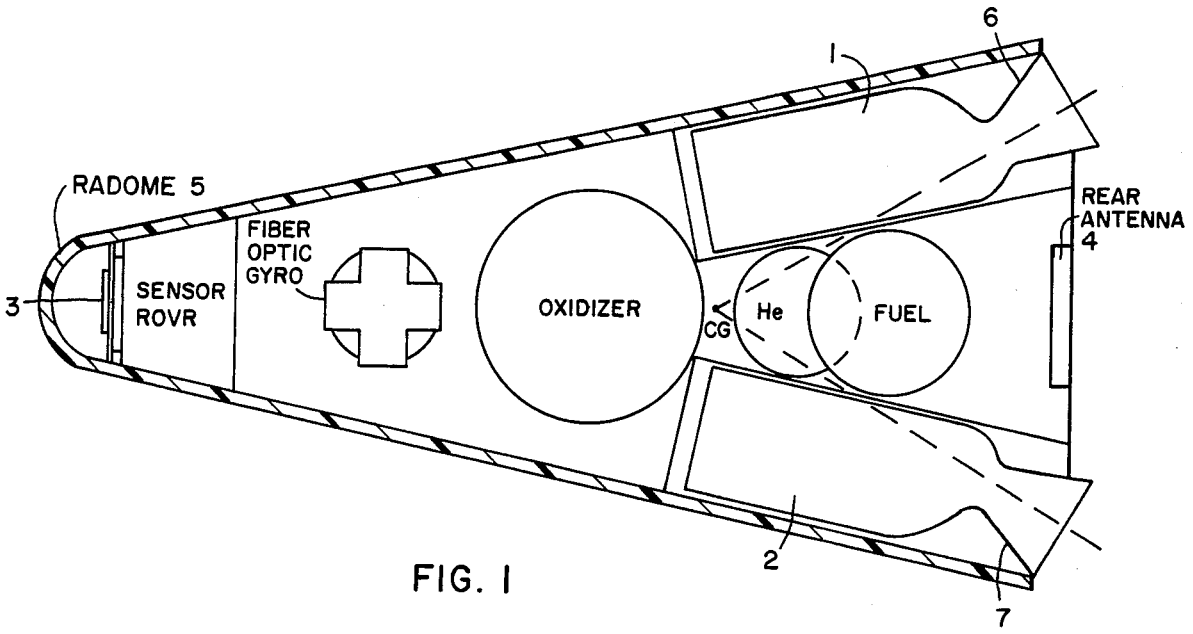
FIG. 1 is an illustration of the spin operated missile.
Figure 2:
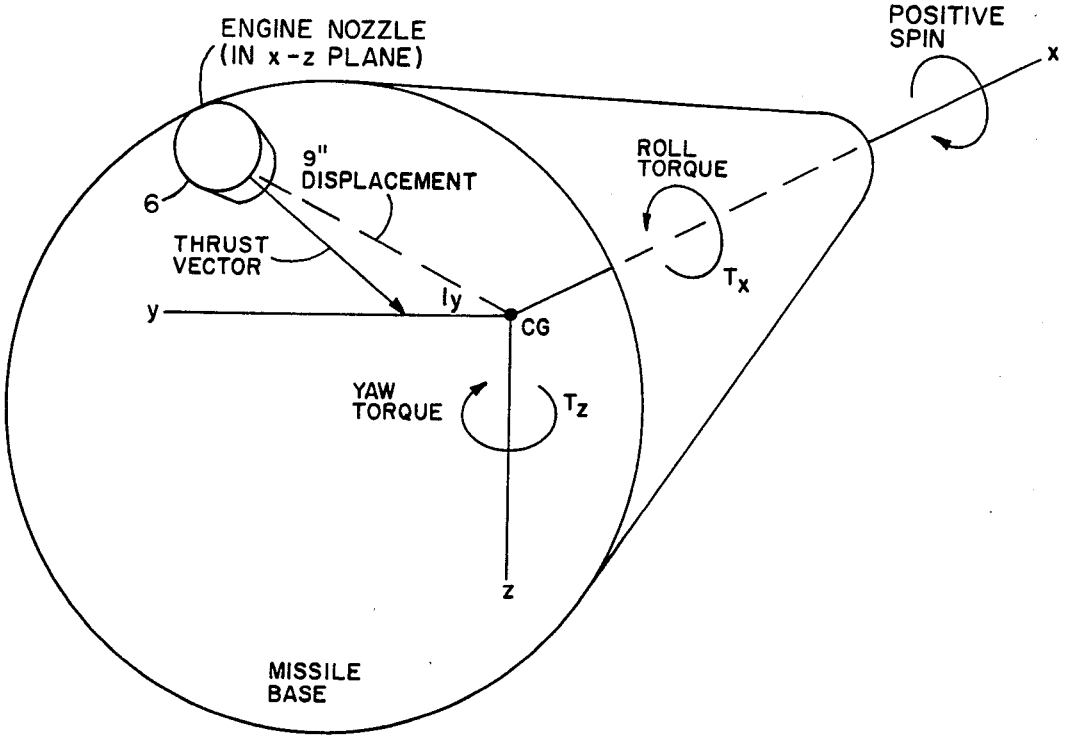
FIG. 2 is an illustration of the orientation of the pulse motor in the missile.

The baseline SSICM configuration is shown in FIGS. 1 and 2. There are two liquid pulse motors 1 and 2 located 180° apart in roll. The pulse motor nozzles 6 and 7 are canted 30 degrees to the missile centerline so that their line of thrust goes through the missile center gravity (CG). This results in 50% of the thrust acting in the lateral direction and 86.6% acting in the axial direction. The missile cone angle is adjusted to prevent the canted motor plume from inducing excessive flow separation when a motor is fired. Some aerodynamic moment impulse from flow separation is tolerable depending on the application.

For semi-active RF guidance, the antenna 3 is a body mounted patch type. The antenna beam is forward staring with a beamwidth dependent on the application.

The unique feature of SSICM is the combination of spinning with 1 a conical configuration, 2 canted motor nozzles, 3 pulse motors and 4 a body mounted sensor.

FIGS. 1 and 2 are exagerated views of the SSICM configuration which emphasizes the orientation of the liquid pulse motors 1 and 2. Note that the engine nozzle is located at a radial distance of 9.0 inches behind the center of gravity at an angle of 30 degrees with respect to the centerline and in the X-Z plane. However, the nozzle is canted such that the thrust action point intersects the missile Y-axis at a point 0.04 inches to the left of the CG. The primary effect of this orientation is that a 6000# thruster produces a 3000# component of thrust ($F_z$) in the Z direction, and a 17.32 ft-lb torque about the Z-axis ($T_z$, positive using the right hand rule). There is also a small component of force in the y-direction, and a small negative torque about the X-axis which reduces the spin rate by a neglible amount ($0.01H_z$) with each thruster firing. This orientation was chosen to satisfy the relationship:

$$\Delta V/V = \Delta H/H \tag{1}$$

where V is the missile velocity, ΔV is the change in velocity, H is the angular momentum, and ΔH is the change in angular momentum for each thruster firing. The change in missile velocity can be approximated by:

$$\Delta V = \frac{F \sin 30^\circ \, \Delta t}{m} \tag{2}$$

where F is the thrust, 30° is the thruster angle with respect to the missile centerline, Δt is the action time and m is the missile mass. The total angular momentum H can be approximated by:

$$H = PIxx \tag{3}$$

where P is the spin rate and Ixx is the missile moment of inertia about its X-axis (centerline). The change in angular momentum is approximately:

$$\Delta H = F \cos 30^\circ \, ly \, \Delta t \tag{4}$$

where ly is the thruster offset distance from the center of gravity along the y-axis. Substituting expressions (2) through (4) into equation (1) and solving for ly we have:

$$ly = \frac{PIxx \tan 30^\circ}{m\,V}$$

Evaluating for P=60 Hz, Ixx=350 lb-in$^2$, W=40 lbs, and V=4000 fps we have:

$$ly = \frac{2\pi\,(60)\,(350)\tan 30^\circ}{(40)\,(12)\,(4000)} = .04 \text{ inches.}$$

Similar relationships hold for the other thrusters whether two or four are employed.

The basic SSICM concept assumed that the missile is spun up to 60 Hz by its booster, or by a separate spin package prior to endgame. The spin rate does decrease due to roll jet damping and the negative roll torque generated with each thruster firing. However, by virtue of the roll reference system, good guidance system performance can be maintained over a wide range of spin rate.

The detailed six degree of freedom endgame simulation demonstrated good probability of hit performance even when spin rate dropped below 50 Hz. In any event, the 6000 lb thrusters are not used to maintain spin rate.

An alternate approach would be to use a set of smaller thrusters on the base to change the angular momentum vector according to equation number (1), and to maintain the spin rate.

The SSICM guidance and control scheme uses measured body angular rates to calibrate the gain of the body fixed seeker. This assures the proper guidance gain and minimizes the effects of body coupling. This practice is normally ineffective because the frquency content of the body coupling overlaps that of the measured target motion. Since SSICM spins at a high rate (60 Hz), the body motion is modulated relative to the measured target motion. This results in frequency separation between body and target motion. Therefore, filters can be utilized to separate body motion from target motion.

Figure 3:
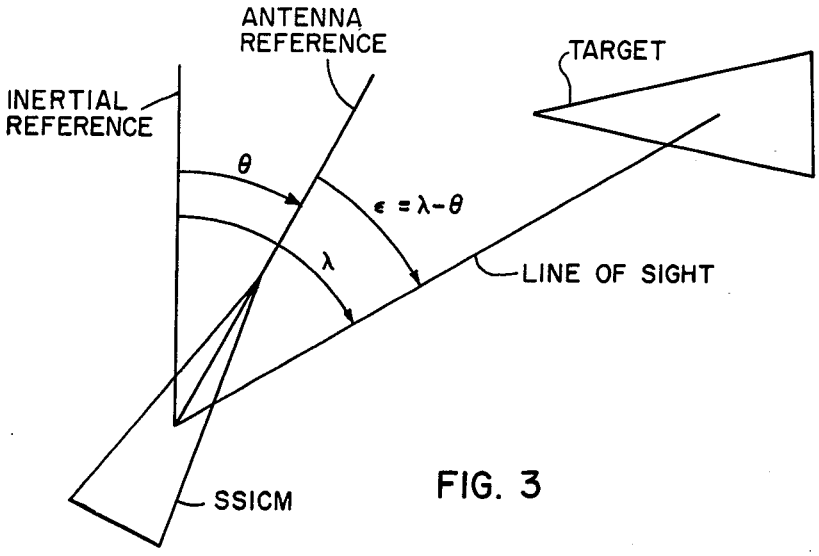
FIG. 3 is a body coupling illustration.

The body coupling problem is illustrated in FIG. 3. Normally, homing systems employ some form of proportional guidance to minimize the rate of change of the line of sight angle, $\lambda$. $\lambda$ is measured from an inertially fixed reference direction to the direction from the missile to the target.

Maintaining a constant $\lambda$ assures a collision course. The guidance scheme is implemented by detecting changes in $\lambda$ and performing corrective maneuvers to minimize changes. This process is illustrated for discrete proportional guidance in FIG. 4. This procedure is straightforward with a gimballed seeker, which measures $\lambda$ directly; however the body fixed seeker 41 measures $\lambda-\theta$, where $\theta$ is the attitude of the missile relative to the fixed reference frame. Missile rotation is coupled into the sensor measurement, and therefore it must be measured and extracted from the seeker output by derivative circuit 42 before the guidance correction is computed. The rate gyro output 43 is mixed 44 with seeker output to produce an error signal which is fed through guidance threshold 45 to impulse control 46.

Figure 4:
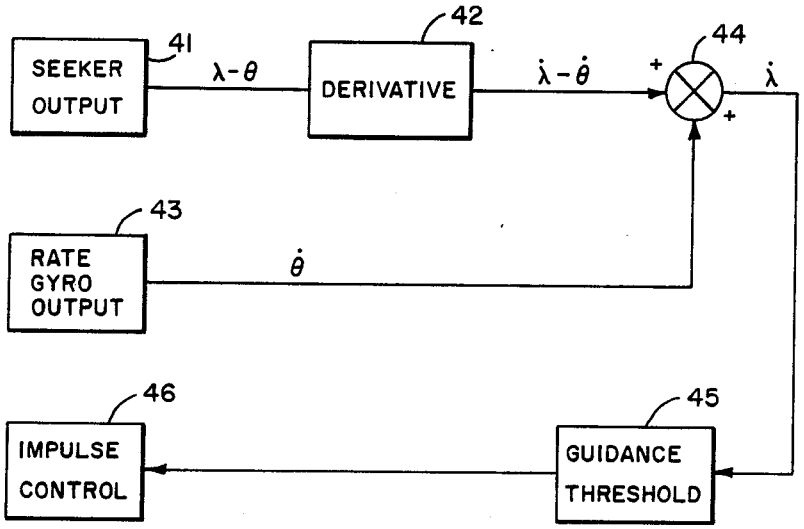
FIG. 4 is a discrete proportional guidance system.
Figure 5:
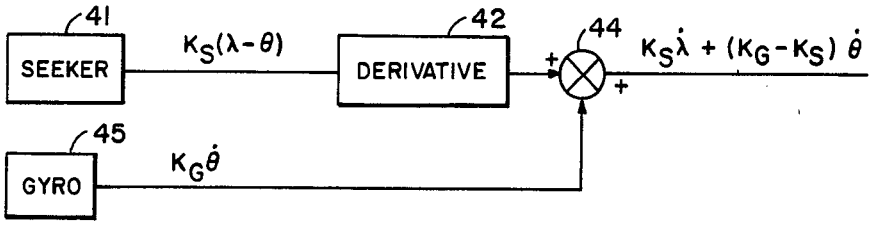
FIG. 5 illustrates residual body motions.

If the seeker were a linear device with an accurate scale factor, body motion could be accounted for as depicted in FIG. 4. However, the seeker is not a linear device and its electronic component amplitude and phase tolerances can produce scale factor errors of as much as $\pm 40$ percent. FIG. 5 shows that, when the seeker scale factor $K_S$ and the gyro scale factor $K_G$ are accounted for, residual body motion will persist in the guidance computation.

Since gyro scale factors are typically very accurate, if the seeker scale factor $K_S$ is adjusted to agree with $K_G$ the guidance gain is corrected and residual body motion is minimized. This is accomplished by using a technique similar to the Automatic Seeker Gain Calibrator (ASGC) developed by R. F. Dutton and W. G. Martin (U.S. Pat. No. 3,414,215, 12-3-1968). The basic difference between the calibrator used for SSICM and the previously developed ASGC occurs because the original application was for a roll stabilized missile with acceleration control.

Figure 6:
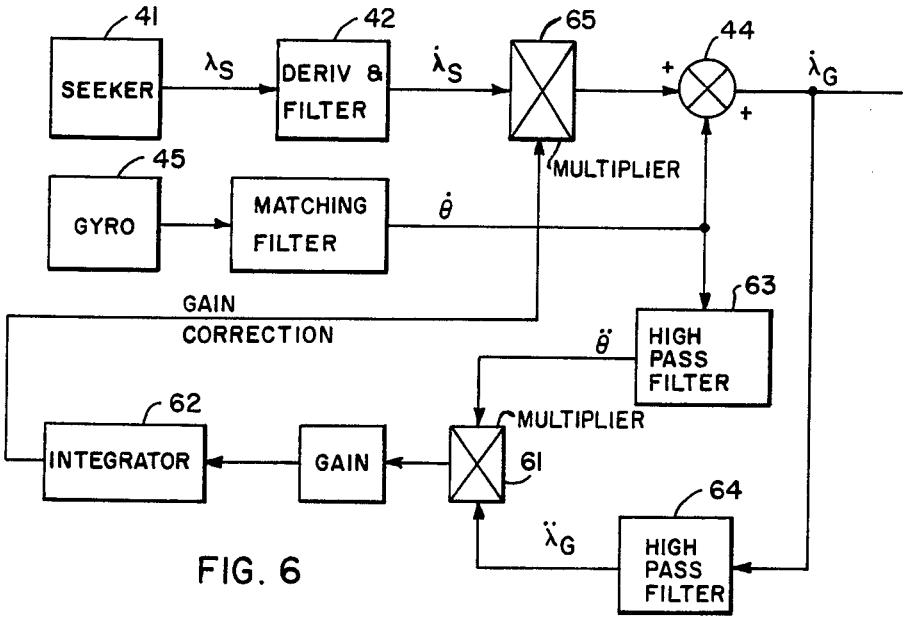
FIG. 6 is an automatic seeker gain calibrator.

A block diagram representation for the ASGC is shown in FIG. 6.

Note that a multiplier 61 is used to correlate the gyro output with the guidance line of sight rate, $\lambda_G$. If the two signals correlate a bias is created which drives the integrator 62 until the scale factor is properly adjusted. In order to emphasize the body motion relative to the target motion, the angular rates are high pass filtered by filters 63 and 64 prior to the correlation. This is necessary to attenuate the effects of the lower frequency target motion on the correlation process. Unfortunately, the target motion (or guidance frequency) does overlap the body angular rate spectrum.

Figure 7:
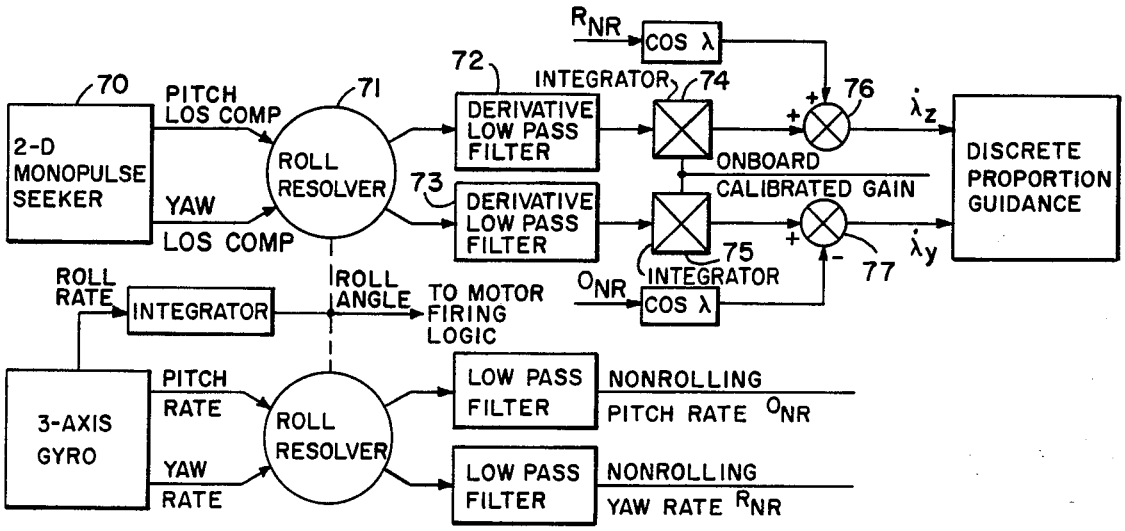
FIG. 7 illustrates the guidance system.
Figure 8:
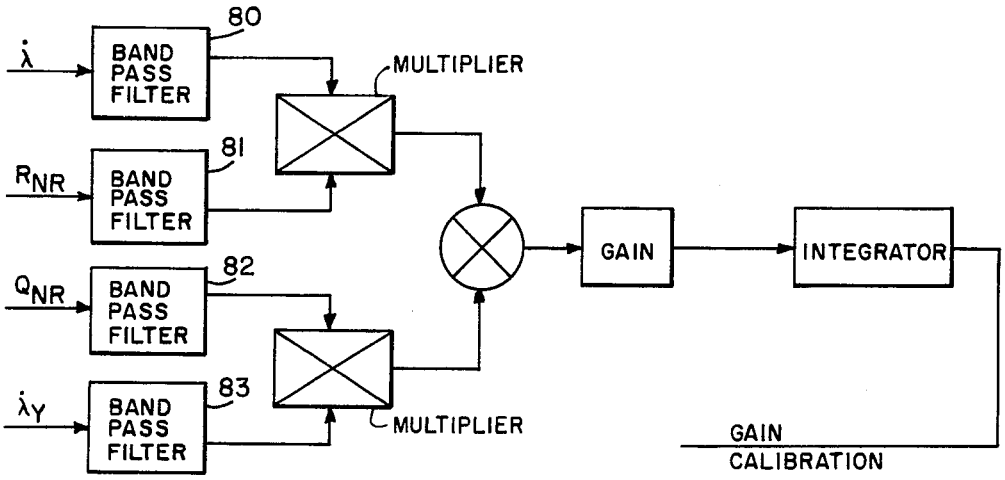
FIG. 8 illustrates the gain calibrators for the spinning system.

Before discussing the gain correlator developed for SSICM, it is helpful to show how it is incorporated into the SSICM Guidance System, FIG. 7.

Note that the body fixed pitch and yaw seeker outputs from seeker 70 are roll resolved by resolver 71 to non-rolling coordinates prior to differentiation by differentiators 72 and 73. The derived non-rolling components include the effects of body nutation and precession, which are amplified by the differentiation process. These components are corrected by the seeker gain calibrator in integrators 74 and 75 before the nutation and precessional components are removed by appropriately summing the roll resolved body angular rates in mixers 76 and 77. The resulting quantities, assuming adequate calibration, are inertial line of sight rate components ($\dot{\lambda}_y$ and $\dot{\lambda}_z$) which are used to implement the guidance algorithm. It can be shown that the seeker gain for the roll resolved components is the average of that for the pitch and yaw components. Therefore, it suffices to derive one gain for both channels. The calibrator implementation for the spinning system as shown in FIG. 7.

Since the SSICM missile was designed with near neutral stability the precessional frequency is approximately zero and the nutational frequency is $I_x/I_y$ times the spin frequency where $I_y$ is the pitch or yaw moment of inertia and $I_x$ is the roll moment of inertia. Therefore, the band pass filters 80–83 can be centered around a very predictable nutational frequency to attenuate the noise effects.

An important issue is the design of the low pass filters associated with the differentiators and matching filters for the rate gyros. The matching filters are required to preserve the phase relationships before the summation process. The seeker outputs typically include sizable bias errors. Bias errors are modulated at the spin rate by the roll resolution. Since the roll frequency is 60 Hz, the biases are amplified by a factor of 377 by the differentiation process. Therefore the low pass filters must be designed to greatly attenuate 60 Hz without creating excessive phase shift at the guidance band ($<10$ Hz). After careful study a 5th order Modified Thompson low pass filter was chosen for this purpose. This filter also provides an abundance of noise attenuation for the guidance system.

The SSICM guidance algorithm is a form of discrete proportional navigation (DPN). With this rule, the line-of-sight rate, $\dot{\lambda}$, is computed by $$\dot{\lambda} = \sqrt{\dot{\lambda}_y^2 + \dot{\lambda}_z^2}$$

where $\dot{\lambda}_y$ and $\dot{\lambda}_z$ are the inertial line-of-sight rate components after filtering and sensor calibration. If $\dot{\lambda}$ exceeds the guidance threshold ($\dot{\lambda}_T$=0.03 rad/s), a pulsemotor correction is ordered. The inertial roll orientation for a pulsemotor firing is given by $$\phi_c = \mathrm{Tan}^{-1}(\dot{\lambda}_z/\dot{\lambda}_y).$$

The time delays required for pulse-motor firings are given by $$t_1 = (\phi_c - \phi)/P - 0.5\ t_A,$$

$$t_2 = (\phi_c - \phi + \pi)/P - 0.5 t_A,$$

where $t_1$ is time to fire motor number one, $t_2$ is time to fire motor number two, $\phi$ is the body roll orientation, P is the spin rate, and $t_A$ is the motor-pulse duration.

The SSICM Guidance and Control Concept takes advantages of "usually undesirable" nutational motion to calibrate its inaccurate onboard seeker. This allows the SSICM to engage high performance RV's with a body fixed seeker. Body fixed seekers have the following advantages over gimbaled seekers:

1. Smaller radome errors
2. Lighter weight
3. Less susceptible to high g environment
4. Easier to manufacture and maintain
5. Less cost.

The primary disadvantage of body fixed seekers is the coupling problem which has been circumvented here.

The impulsive maneuver scheme provides a very short (near instantaneous) response time compared to more conventional aerodynamic schemes. Since miss distance is directly proportional to response time impulsive response provides very small miss distance. This can relieve the warhead and fuzing systems required for more conventional interceptor systems.

I claim:

1. In a missile guidance system for guiding a spin stabilized controlled missile towards a target by proportional navigation, the improvement comprising the method of utilizing fixed body mounted sensors for detecting the relative direction of the target and producing an output signal proportional thereto; generating a rate signal which is proportional to body angle rates of the missile; utilizing filters to separate body motions from target motions in the rate signal; producing a filtered rate signal proportional to the body angle rates; combining the filtered rate signal with the output signal of the sensors for deriving an error signal with respect to guidance of the missile towards the target; and utilizing nutational motion to calibrate said sensors.

2. A method as set forth in claim 1 further comprising the steps of utilizing impulsive maneuvering of the missile which is responsive to the error signal.

* * * * *